US005243886A

United States Patent [19]

Rudy et al.

[11] Patent Number: 5,243,886

[45] Date of Patent: Sep. 14, 1993

[54] METHOD AND APPARATUS FOR PRODUCING DICED PRODUCTS

[75] Inventors: Norman A. Rudy, Renton; James S. Tomlin, Seattle; Bret J. Larreau, Redmond, all of Wash.

[73] Assignee: Frigoscandia Food Processing Systems A.B., Helsingborg, Sweden

[21] Appl. No.: 877,359

[22] Filed: May 1, 1992

Related U.S. Application Data

[63] Continuation of Ser. No. 701,893, May 17, 1991, abandoned.

[51] Int. Cl.[5] ..... B26D 3/18; B26F 3/00

[52] U.S. Cl. ..... 83/19; 83/53; 83/177; 83/614; 83/620; 83/932; 99/516

[58] Field of Search ..... 83/19, 53, 56, 177, 83/176, 404.4, 408, 614, 932, 618, 620, 578; 99/516, 536; 452/155-157

[56] References Cited

U.S. PATENT DOCUMENTS

| | | | |
|---|---|---|---|
| 2,024,517 | 12/1935 | Fowler | 83/751 X |
| 3,684,140 | 8/1972 | Voss | 83/176 X |
| 3,886,827 | 6/1975 | McCarthy | 83/751 X |
| 4,266,112 | 5/1981 | Niedermeyer | 83/53 X |
| 4,356,205 | 10/1982 | Richards | 83/19 X |
| 4,735,566 | 4/1988 | Squicciarini | 83/177 X |
| 4,875,254 | 10/1989 | Rudy et al. | 83/177 X |
| 4,876,934 | 10/1989 | Fagan et al. | 83/53 X |
| 5,031,496 | 7/1991 | Lobash et al. | 83/177 X |

*Primary Examiner*—Eugenia Jones

*Attorney, Agent, or Firm*—Olson & Olson

[57] ABSTRACT

Apparatus for producing diced food product includes a endless wire mesh conveyor belt for supporting food product to be diced. In one embodiment, a plurality of high pressure water jet nozzles are spaced apart on a water manifold that extends in the longitudinal direction of the conveyor belt and is reciprocative across the conveyor belt. The jets of water pass through the product, the belt and a slotted grid matching the spacing of the water jets. In one specific arrangement, the nozzles extend over a length at least equal to twice the length of transverse movement of the manifold less the distance between adjacent nozzles, and the speed of movement of the manifold and conveyor belt are equal, whereby to produce diced food product of square configuration. In another arrangement, the speed of movement of the manifold or belt is made faster or slower than the other, whereby to produce diced product of diamond configuration. In still another arrangement, selected nozzles are omitted, whereby to produce diced product of square and rectangular shapes. In another embodiment, a plurality of nozzles are spaced apart on two elongated water manifolds that extend transversely across the conveyor belt and are spaced apart in the longitudinal direction of the belt. The two manifolds are mounted on a carriage for simultaneous reciprocation across the conveyor belt. The nozzles on one manifold are offset laterally relative to the nozzles on the other manifold. The lateral offset determines one dimension of the cut dices.

15 Claims, 8 Drawing Sheets

METHOD AND APPARATUS FOR PRODUCING DICED PRODUCTS

This application is a continuation of U.S. patent application Ser. No. 07/701,893, filed May 17, 1991, now abandoned.

BACKGROUND OF INVENTION

This invention relates to the production of articles in diced form, and more particularly to method and apparatus for dicing cooked chicken and other food products.

Food products, such as cooked chicken, turkey, beef, vegetables and others, are useful in diced form for incorporation into soup and stew stocks, salads and other dishes. In the commercial production of such food products heretofore, they have been subjected to the action of rotating cutter blades arranged to reduce the food product to diced form. Such rotating blades have not been completely satisfactory, however, for several reasons: They produce excessive amounts of fines, torn and partial pieces of random sizes and shapes, all of which degrade the quality of the product. Such mechanical cutter blades also allow cross-contamination of product by re-using the blades to cut a plurality of succeeding products delivered to the cutter mechanism. The blades require frequent sharpening and often become broken, contributing to excessive loss of production time and correspondingly increased cost of production.

SUMMARY OF THE INVENTION

In its basic concept, the method and apparatus of this invention involves moving a product to be diced on a conveyor past a plurality of longitudinally spaced line-type cutters which reciprocate transversely across the conveyor at a rate of speed relative to the rate of speed of the conveyor predetermined to cut the moving product to a selected shape and size.

It is the principal objective of this invention to provide method and apparatus of the class described which overcomes the aforementioned limitations and disadvantages of prior dicing equipment and methods.

Another objective of this invention is the provision of method and apparatus of the class described which enables large scale commercial production of diced products of high quality and with speed, facility and economy.

Still another objective of this invention is the provision of method and apparatus of the class described for producing diced products of diverse shapes and sizes.

A further objective of this invention is the provision of apparatus of the class described in which a plurality of line-type cutters is provided by a manifold delivering high pressure water to a plurality of high pressure water cutting jets.

A still further objective of this invention is to provide apparatus of the class described in which a plurality of high pressure water cutting jets are mounted adjustably on a supply manifold for varying the spacing between cutting jets, whereby to vary the size of dices of product.

Still another objective of this invention is the provision of apparatus of the class described which is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 1:
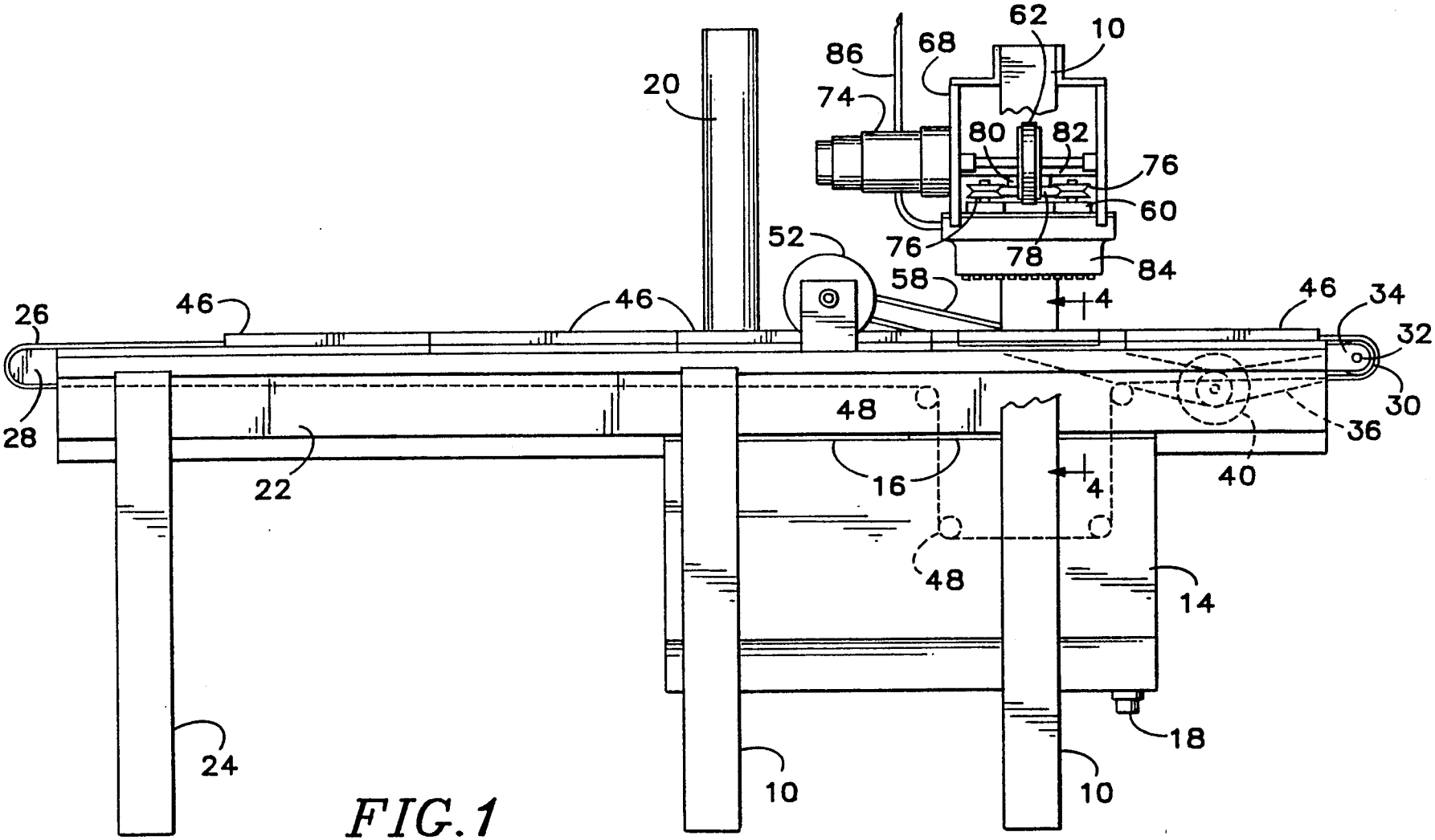
FIG. 1 is a view in side elevation of product dicing apparatus embodying the features of this invention.

The apparatus illustrated includes a supporting framework formed of vertical frame members 10 and horizontal frame members 12. This framework supports a water reservoir 14 provided with a plurality of top plates 16 and a drain plug 18 at its bottom end. An elongated vent pipe 20 extends upwardly through one of the top plates 16.

Figure 4:
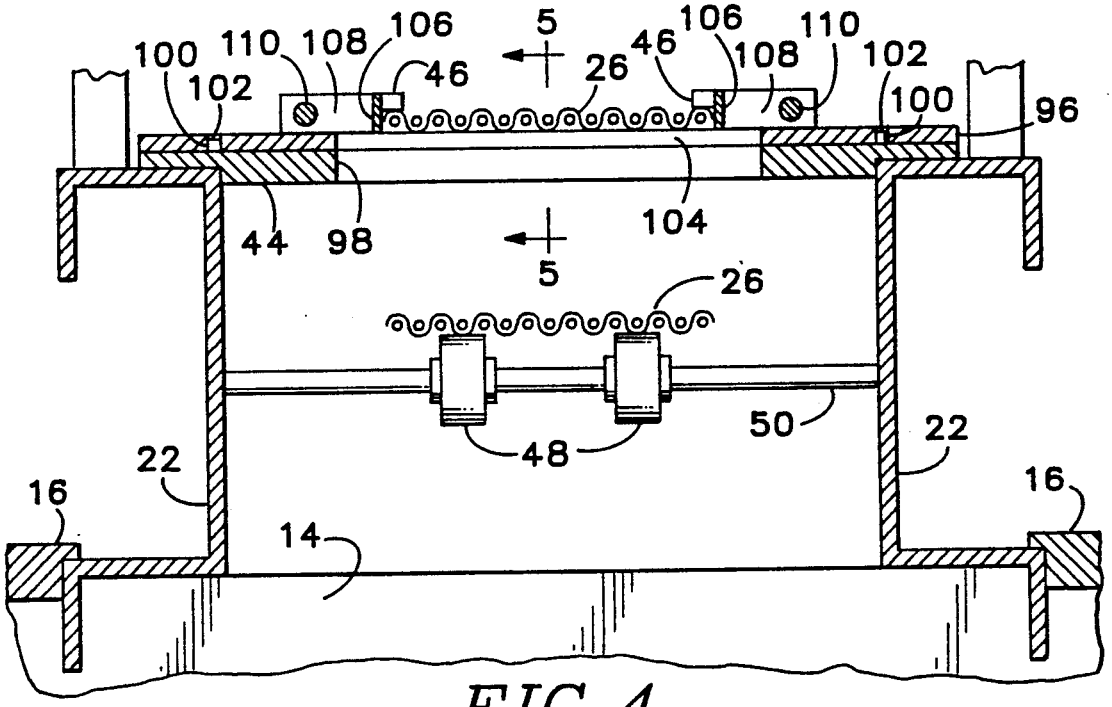
FIG. 4 is a fragmentary sectional view, on an enlarged scale, taken on the line 4—4 in FIG. 1.

A product conveyor is formed of laterally spaced, elongated frame members in the form of channel beams 22 (FIG. 4) supported adjacent the infeed end by vertical frame legs 24. The opposite, outfeed end portion of the conveyor frame is supported by the top of the reservoir 14.

An elongated endless conveyor belt 26, preferably in the form of wire mesh, is supported at the infeed end of the conveyor frame by a rounded stationary rub bar 28 of polyethylene or other suitable synthetic plastic. The rub bar also serves as a support bed for the conveyor belt.

The opposite, outfeed end of the conveyor belt 26 is supported at the outfeed end of the frame by outfeed drive sprockets 30 the shaft 32 of which is supported in bearings mounted on bearing supports 34. The shaft 32 is driven by drive chain 36 which interconnects the shaft 32 with the output shaft 38 of electric motor 40 secured to support bracket 42 on the tank 14.

The upper working stretch of the conveyor belt 26 between the rub bar 28 and the drive sprockets 30 is supported by a plurality of support beds 44 mounted removably on the channel beams 22. A pair of laterally spaced belt guides 46 serve to confine between them the conveyor belt 26 and the product supported on and transported by the belt. The lower, slack stretch of the belt is supported on idler rolls 48 carried on a shaft 50 extending between the channel beams.

Positioned above the conveyor belt 26 intermediate the ends of the latter is a flattening roll 52 the drive shaft 54 of which is supported for rotation in bearings carried by bearing supports 56. The drive shaft 54 is coupled to the output shaft 38 of the drive motor 40 by drive chain 58.

A cutter carriage 60 is secured to the lower stretch of an endless drive belt 62 supported at one end on an idler roll 64 the shaft 66 of which is journaled in bearings carried by the transversely elongated support frames 68. The opposite end of the drive belt is supported by drive roll 70 the drive shaft 72 of which is journaled in bearings carried by the support frames 68. The drive shaft 72 is connected directly to the output shaft of carriage drive motor 74. This motor preferably is of the servo type and is coupled to the conveyor belt drive motor 40 through an electronic controller (not shown) which functions to correlate the speed of the servo motor to the speed of motor 40. Thus, the carriage drive servo motor 74 may be matched precisely to that of the conveyor belt drive motor 40, or it may be adjusted precisely to speeds different from that of motor 40. A typical servo motor is Model MAC 90 B manufactured by Rexroth Corporation. A typical electronic controller is Model CLM-OIA manufactured by Rexroth Corporation.

Referring primarily to FIG. 1 of the drawings, the cutter carriage 60 is stabilized for movement with the drive belt 62 by the rolling interengagement of four guide wheels 76 on the carriage and the central, longitudinal guide track 78. The guide track is supported by a backing plate 80 the opposite ends of which are supported by transverse cross members 82 secured to the spaced support frames 68.

Figure 6:
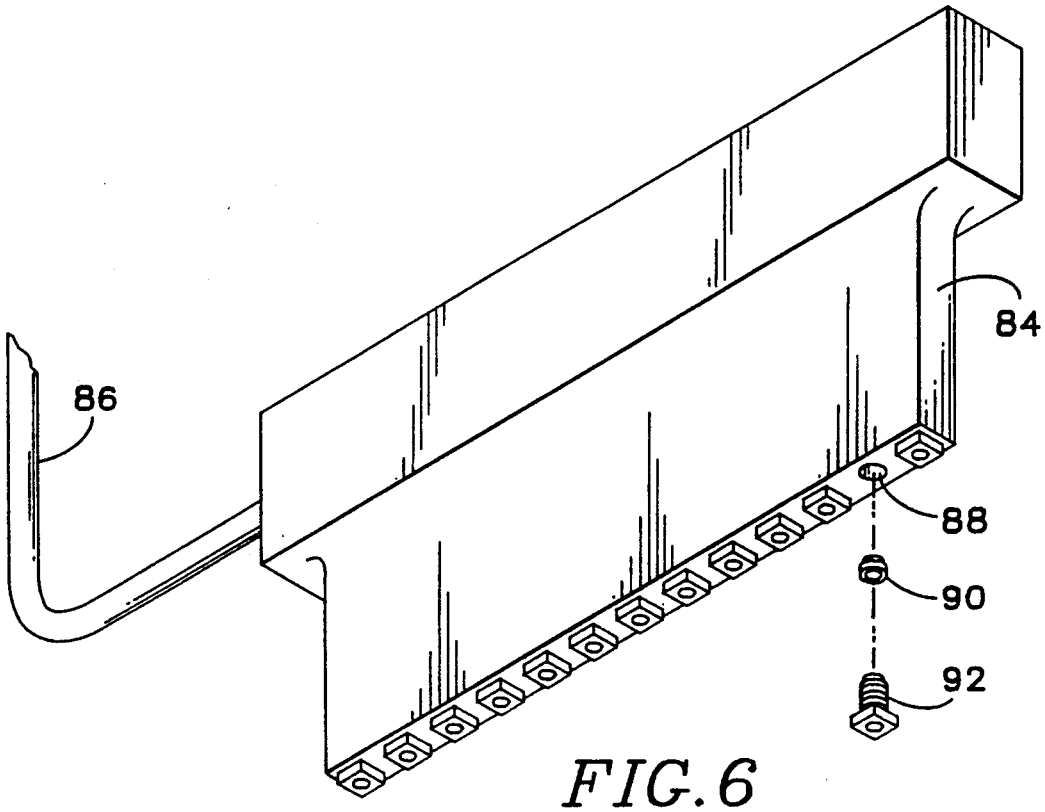
FIG. 6 is a bottom perspective view, on an enlarged scale, of the high pressure water cutting jet manifold component of the apparatus of the preceding views.

The cutter carriage 60 supports a high pressure water manifold 84 which is supplied with high pressure water by delivery pipe 86 which communicates with a source of high pressure water (not shown). As best illustrated in FIG. 6, the lower end of the elongated manifold is provided with a plurality of spaced water ports 88. Each of these ports is configured for the removable reception of a nozzle orifice 90 which is secured in position within the port by a nozzle screw 92 which engages a threaded portion of the port.

Figure 2:
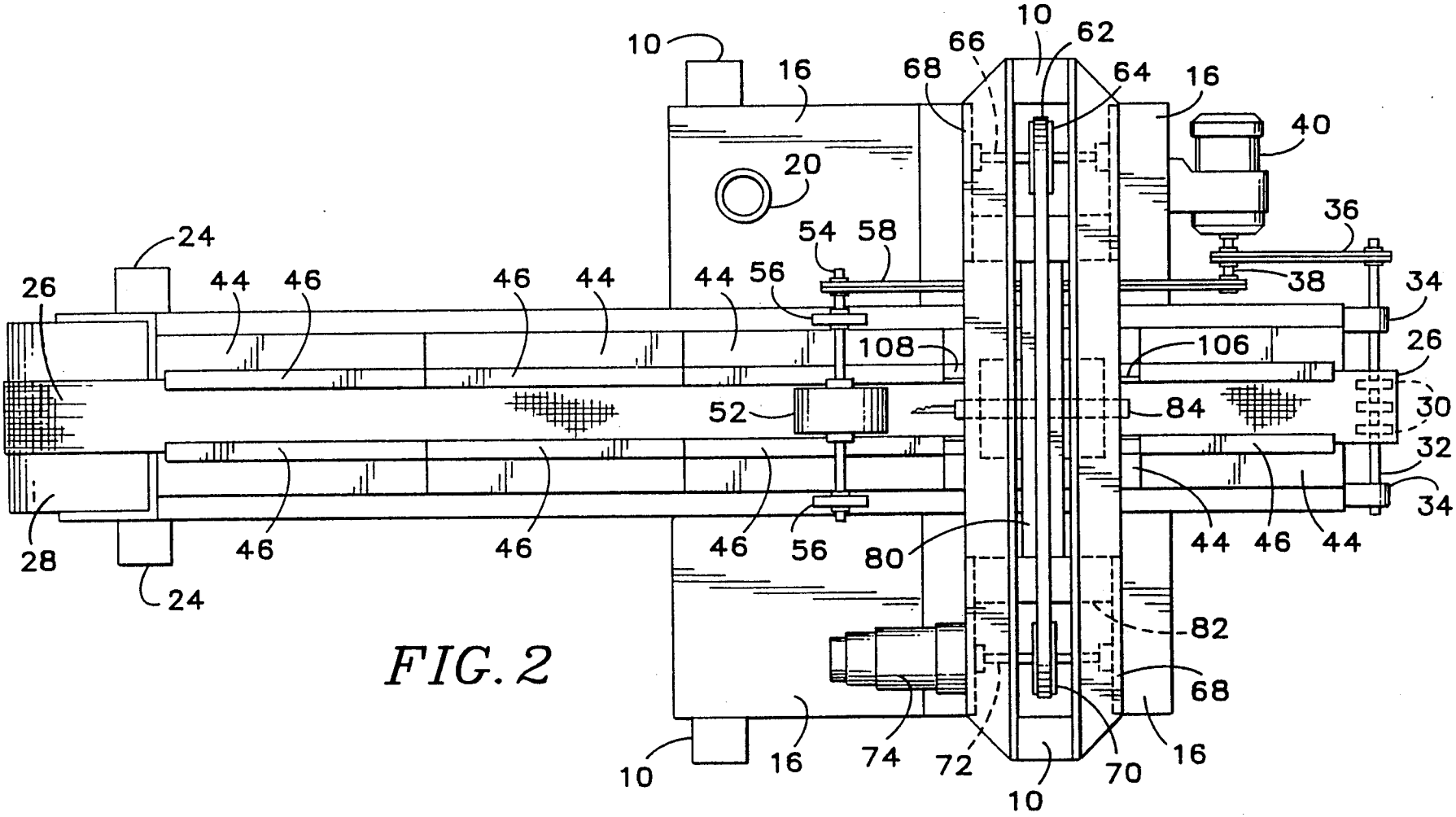
FIG. 2 is a plan view as viewed from the top in FIG. 1.
Figure 3:
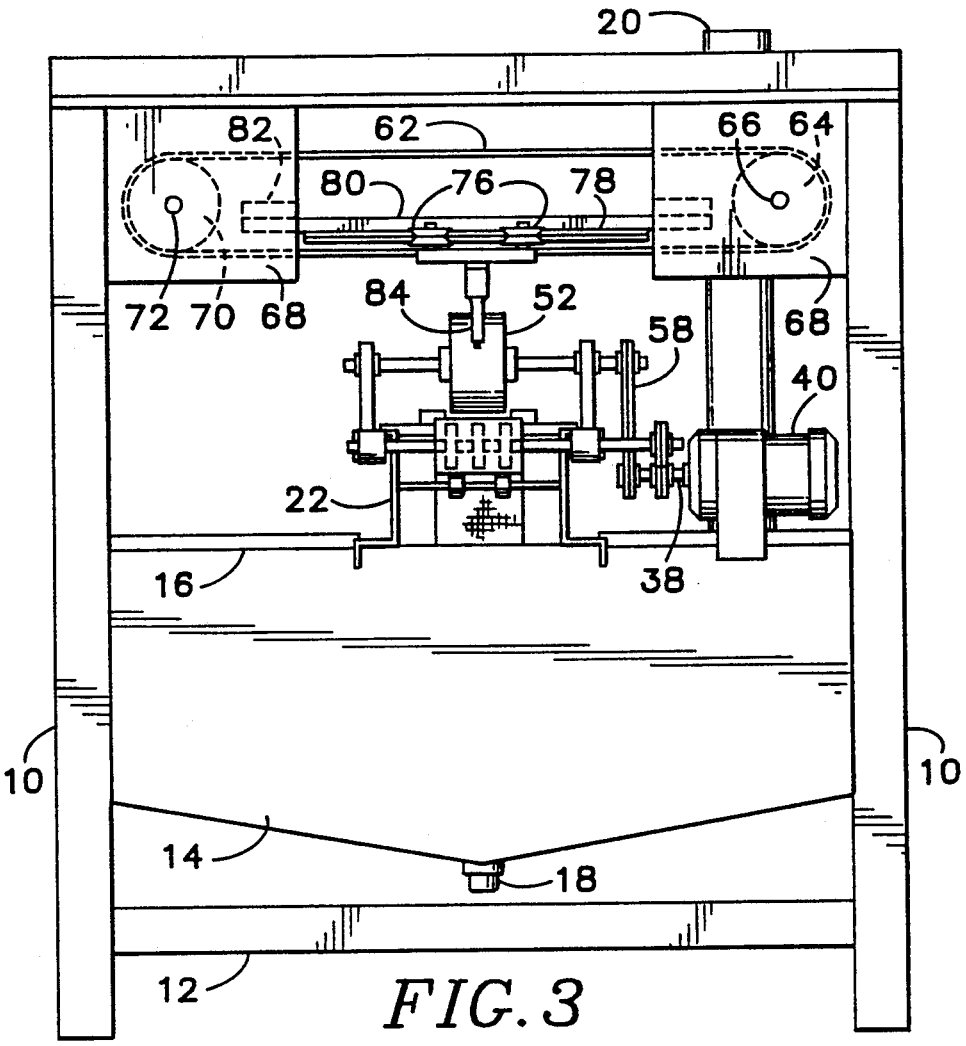
FIG. 3 is a view in end elevation as viewed from the right in FIG. 1.

It is to be noted from FIGS. 1 and 2 that the manifold 84 is mounted on the carriage 60 so that the line of nozzle orifices 90 and screws 92 extends parallel to the longitudinal movement of the conveyor belt 26. It is also to be noted that the carriage drive belt 62 extends in the direction transversely across the conveyor belt 26, whereby to move the manifold in the direction perpendicular to the direction of movement of the conveyor belt. The cutter carriage drive motor 74 is of the reversible type, whereby to effect reciprocative movement of the manifold transversely across the conveyor belt.

Figure 5:
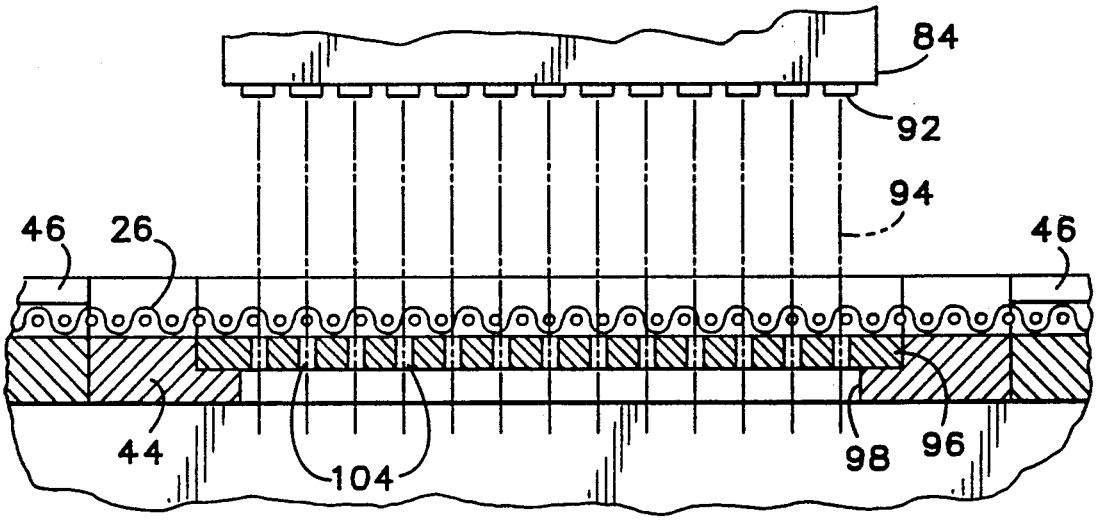
FIG. 5 is a fragmentary sectional view, on an enlarged scale, showing the cooperative structural arrangement of the water jet manifold, wire conveyor belt, water jet grid plate and water recovery reservoir.

Each of the orifices 90 produces a tiny jet 94 (FIG. 5) of high pressure water which is directed toward the conveyor belt 26. These jets of high pressure water form line-type cutters which, unlike rotary cutter blades, afford cutting of product while the product moves in a direction perpendicular or otherwise angular to the direction of movement of the cutters.

The magnitude of the high pressure water is sufficient to cut the food product carried on the conveyor belt 26 but is insufficient to cut the wire mesh of the belt. The high pressure water jets pass through the conveyor belt and a water jet grid plate 96 (FIG. 5) underlying the conveyor belt. The water jet grid plate is supported in a recess in the support bed 44 which overlies the reservoir 14, and overlies a large opening 98 in the support bed. Pins 100 on the support bed are received in registering openings 102 in the grid plate to secure the latter against lateral displacement.

The water jet grid plate 96 is provided with a plurality of elongated slots 104 which are aligned with the plurality of nozzle orifices 90 to allow passage of the high pressure water jets 94 through said slots and the opening 98 in the support bed, into the water reservoir 14. A separate grid plate 96 is provided for each of a plurality of manifolds 84 to align the slots 104 with the differently spaced orifices 90 which afford the production of dices of different sizes.

Side guide members extend along the sides of the support bed associated with the water jet grid plate 96. The guide members align with the belt guides 46. Each guide member includes a thin, vertical blade 106 positioned adjacent the associated side edge of the conveyor belt 26 inwardly of the ends of the slots 104, to allow the water jets 94 to pass over the blade 106. The blade is secured at its ends to end blocks 108 which are spaced apart by connecting rod 110.

Figure 7:
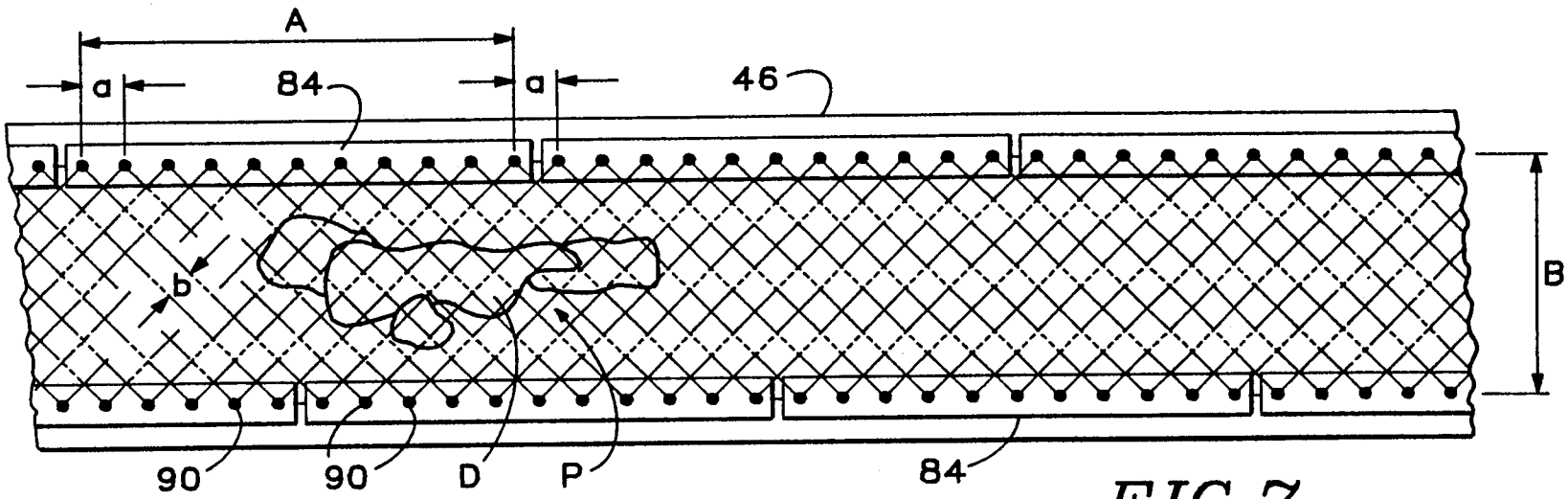
FIG. 7 is a fragmentary plan view of the conveyor component of the apparatus of the preceding views illustrating schematically the cutting operation performed by the transversely reciprocative high pressure water cutting jet assembly to produce square dices.

Referring now to FIG. 7 of the drawings, the mode of operation of the invention is illustrated schematically by the association of the longitudinally movable conveyor belt 26 and the transversely reciprocative manifold 84. For purposes of illustrating the preferred mode of operation which results in the production of dices of square configuration, it is required that the speed of movement of the transversely reciprocative manifold be the same as the speed of longitudinal movement of the conveyor belt. The transverse line of movement of each nozzle orifice thus is relative to the longitudinal line of movement of the conveyor belt 26, as illustrated in FIG. 7. It is also apparent in FIG. 7 that the length A between the end nozzle orifices 90 must be at least equal to 2B-a, i.e. twice the length B of transverse movement of the manifold 84, less the distance a between adjacent orifices 90. In the embodiment illustrated, the length B is the same as the operating width of the conveyor belt between the belt guides 46.

Further, the spacing a between adjacent nozzle orifices 90 is chosen to provide the desired spacing b of the effective cuts produced by adjacent high pressure water jets 94. For example, if it is desired that the food product P be diced to 12.7 mm (one-half inch) squares D, the spacing a between adjacent nozzle orifices is 18.0 mm (0.707 inch). Similarly, if it is desired that the food product be diced to 9.5 mm (0.375 inch) squares, the spacing a between adjacent nozzle orifices is 13.5 mm (0.53 inch).

It will be apparent from the foregoing that a plurality of manifolds 84 may be provided, each with different numbers of orifices 90 and/or different spacings between them, to produce diced product of different sizes and shapes.

The manifold arrangement of nozzle orifices 90 also allows for varying the sizes of the diced food product D. For example, if it is desired to produce diced food product 25.4 mm (one inch) square, every other nozzle orifice 90 of the manifold spacing 18.0 mm (0.707 inch) may be removed and the port 88 plugged. In this manner the spacing a between adjacent orifices will be 36 mm (1.414 inch) and the spacing b between adjacent high pressure water jet cuts will be 25.4 mm (one inch). In similar manner, every other nozzle orifice of the manifold arrangement in which the nozzle orifices are spaced apart 13.5 mm (0.53 inch), may be removed and the ports plugged, to provide the production of diced product of 19.1 mm (0.75 inch) square.

Figure 8:
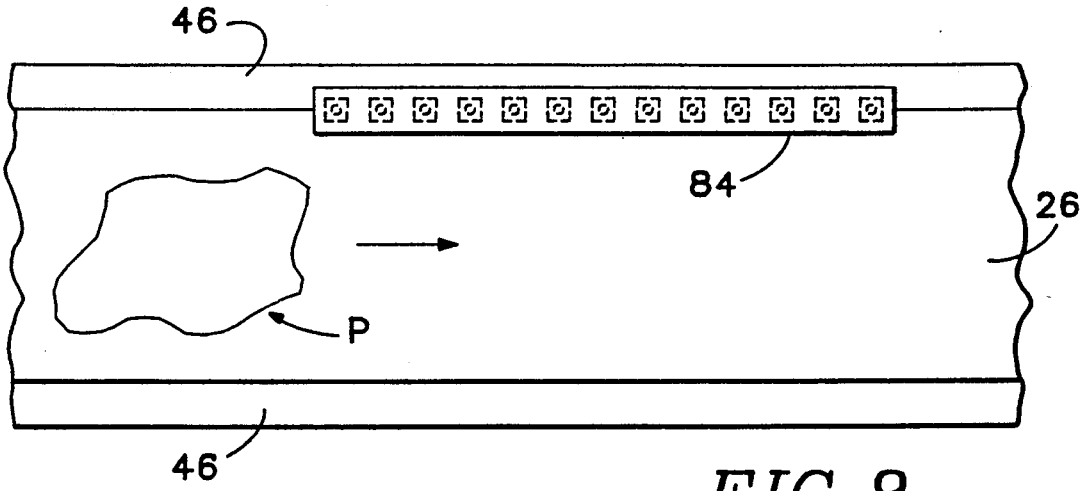
FIGS. 8, 9 and 10 are fragmentary plan views of the conveyor belt illustrating the cutting of product as it moves with the conveyor belt while the cutter manifold traverses the conveyor belt from one side to the other and then back to the starting side.
Figure 9:
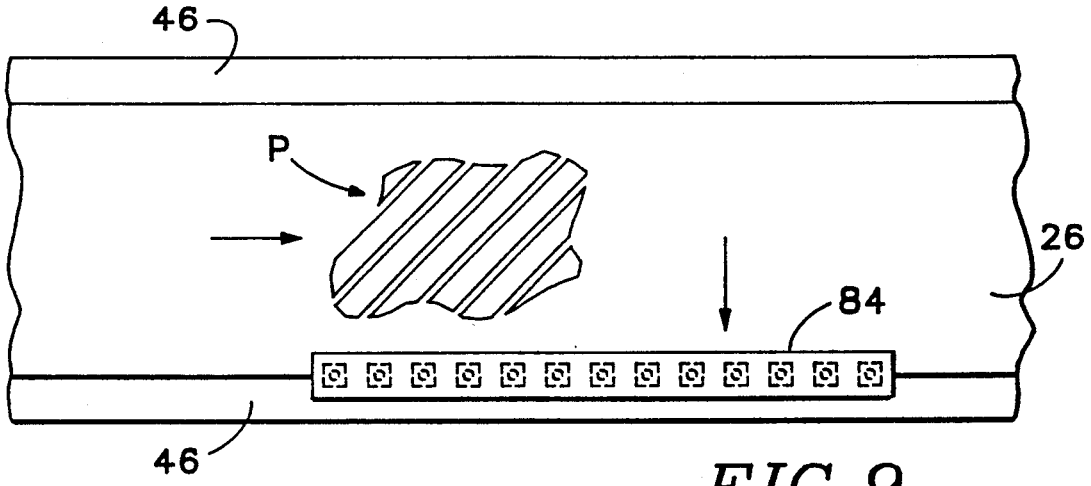
Figure 10:
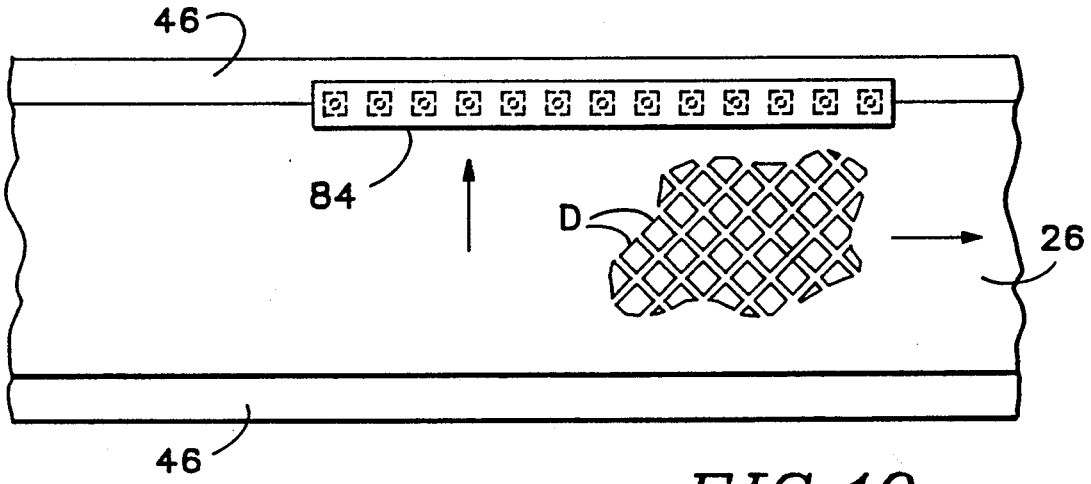

In all cases, and as illustrated in FIGS. 8–10, it is required that the manifold 84 must be able to move transversely across the conveyor belt 26 in one direction (from FIG. 8 to FIG. 9) and return in the opposite direction to the starting point (from FIG. 9 to FIG. 10) before the conveyor belt moves longitudinally a distance equal to the length A between the end nozzle orifices 90. It is by this arrangement that all food product P moving on the conveyor belt is subjected to the cutting action of the high pressure water jets in both reciprocative directions of the manifold, to produce the multiplicity of dices D desired.

Figure 11:
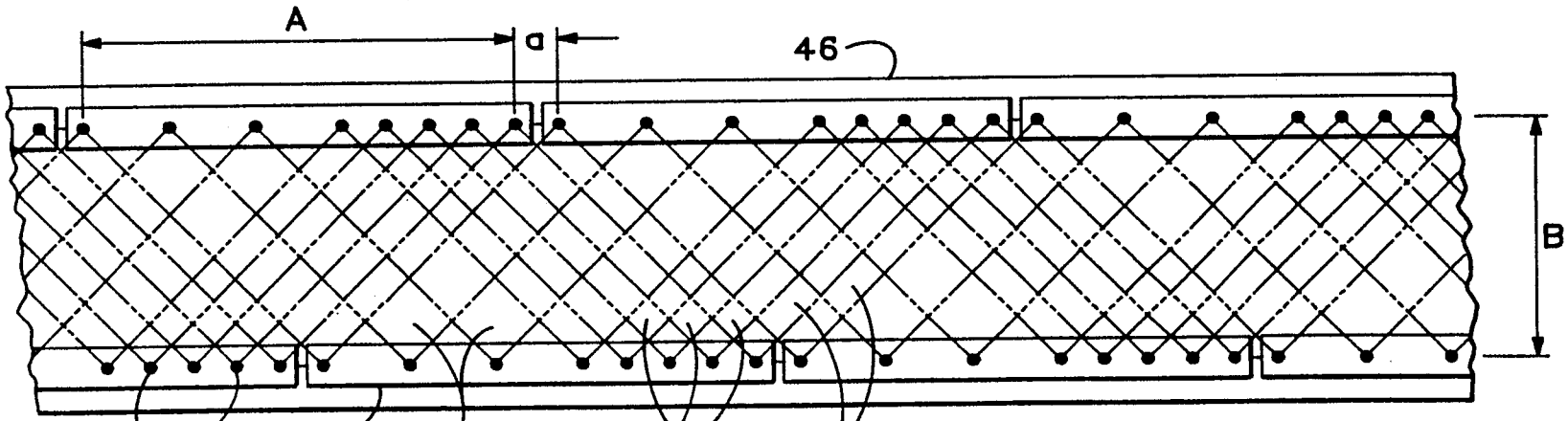
FIG. 11 is a fragmentary plan view of the conveyor component of the apparatus, similar to FIG. 7, illustrating schematically the cutting operation performed by a modified arrangement of high pressure water cutting jets on the manifold to produce dices of rectangular and variously sized square shapes.

FIG. 11 illustrates schematically an arrangement of nozzle orifices by which to produce a random pattern of dices of square shape of two different sizes and dices of rectangular shape. In this arrangement, the second, fourth and sixth nozzle orifices from the left end of the manifold 84 are removed and the ports 88 plugged. Reciprocation of the manifold transversely of the conveyor belt 26 at the same rate of movement thus results in the production of square dices D-1 which are twice the size of the square dices D-2, and also of rectangular dices D-3 having one dimension the same as dices D-1 and the other dimension the same as dices D-2.

It is also to be noted that diced product D having various diamond shapes may be provided by adjusting the speed of movement of either the conveyor belt 26 or the manifold 84 to be different from the other. This is achieved by adjustment of the electronic controller previously mentioned. The magnitude of the difference in speeds will produce dices of correspondingly different diamond shapes.

Moreover, the distance A between the end nozzle orifices 90 of the manifold 84 relative to the distance B of transverse travel of the manifold also will vary as the relative speeds vary. Thus, as the speed of transverse movement through the distance B increases, the length A may decrease. Conversely, as the transverse speed over the distance B decreases, the length A must be increased.

When processing certain types of food product, such as cooked chicken fillet, it is desirable to remove as much of the entrapped air in the food product prior to subjecting it to the cutting action of the high pressure water jets. For this purpose the food product is subjected to the compressing action of the flattening roll 52 prior to delivery of the food product to the area of the water jets. This enables dicing of the product to precise dimensions. The thickness of the compressed food product preferably is about 25 mm (one inch), although the thickness may be varied over a substantial range.

It will be understood that food product to be diced is deposited on the wire mesh conveyor belt 26 adjacent the infeed rub bar 28 and between the belt guides 46. The food product may be dispersed at random over the belt or arranged in a relatively closely packed pattern. In all cases, all of the food product is subjected to the cutting action of the plurality of high pressure water jets in both directions of the reciprocative movement of the manifold 84, to produce the diced product of desired size and shape and with substantial reduction of fines, partial and torn pieces and random sizes. The clean, treated water is used only once on its pass through the food product, and thereby avoids the cross-contamination of mechanical cutter blades. The output of the apparatus accordingly is diced food product of high quality, and the speed of operation with minimum down time assures maximum production at minimum cost.

Figure 12:
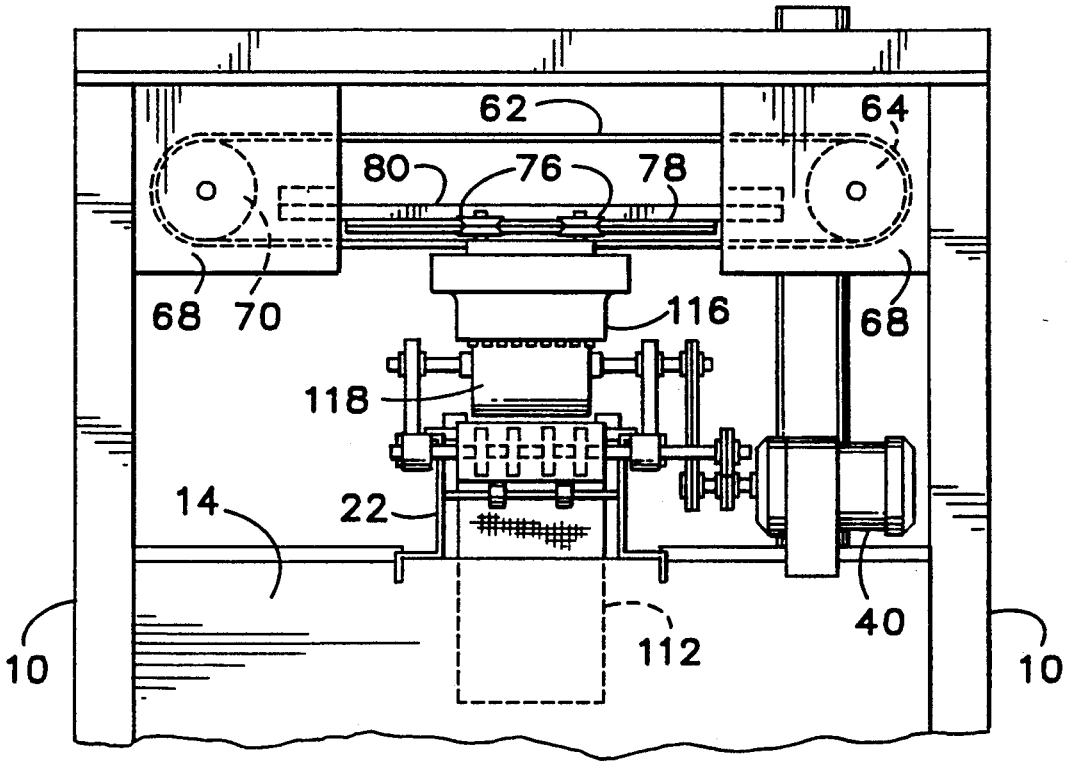
FIG. 12 is a fragmentary end elevation, similar to FIG. 3, showing a modified form of high pressure water jet cutting component.
Figure 13:
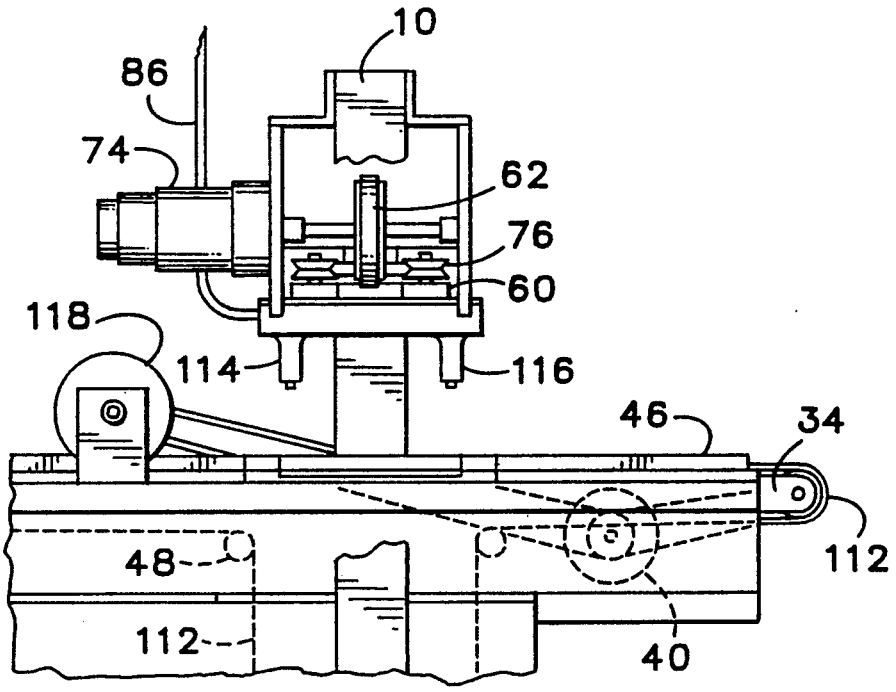
FIG. 13 is a fragmentary side elevation, similar to FIG. 1, showing the modified cutting component of FIG. 12.
Figure 14:
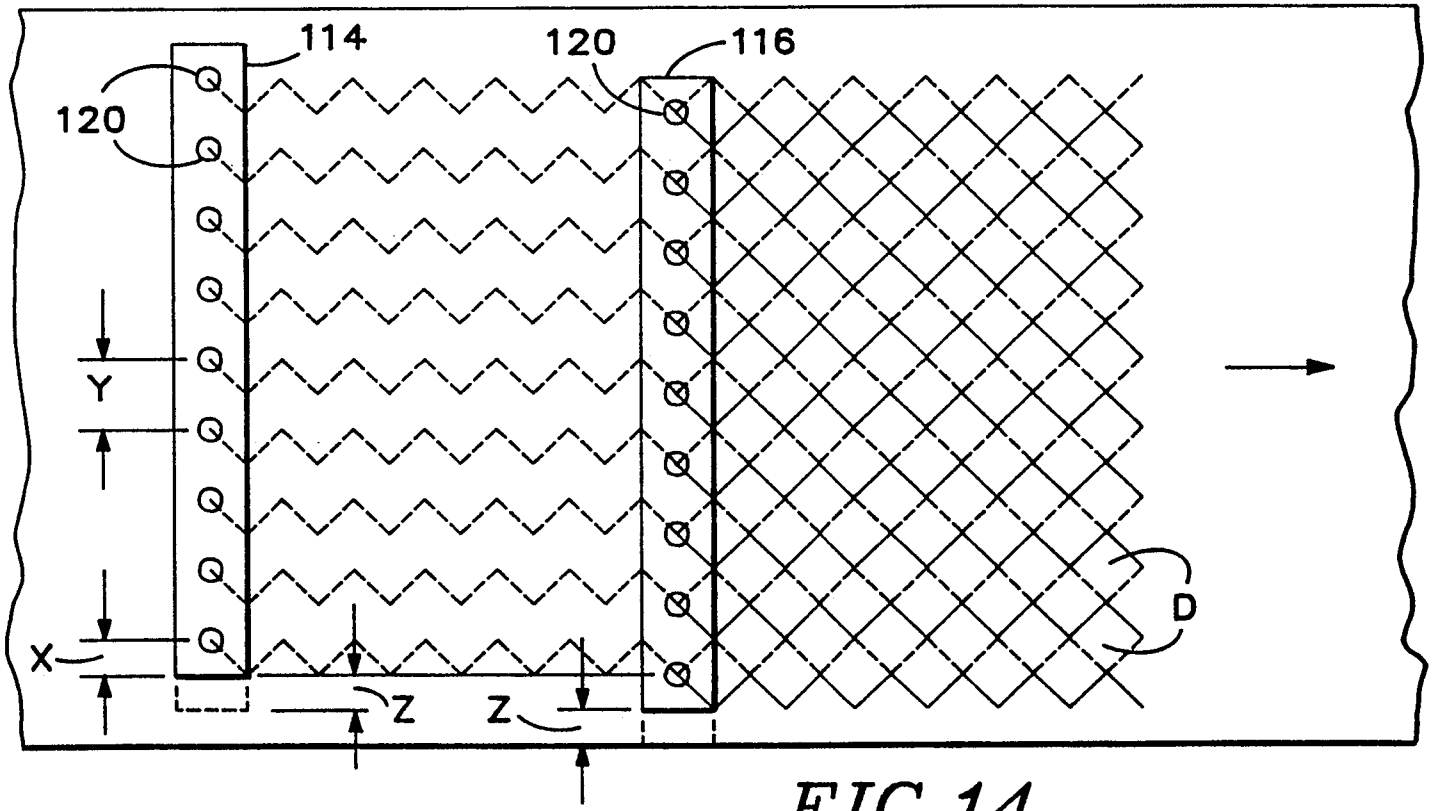
FIG. 14 is a fragmentary plan view, similar to FIG. 7, illustrating schematically the cutting operation performed by the cutting component of FIGS. 12 and 13.

The embodiment illustrated in FIGS. 12, 13 and 14 affords greater production of diced product by enabling the use of a wider conveyor belt 112 upon which to support a greater volume of product to be diced. The manifold 84 of the embodiment described hereinbefore is replaced by two parallel manifolds 114 and 116 mounted upon the carriage 60. The manifolds are disposed to extend across the transverse dimension of the conveyor belt and are spaced apart in the longitudinal direction of movement of the conveyor belt. Flattening roll 118 is dimensioned to span the operative width of the wider conveyor belt.

Referring to FIG. 14, it is to be noted that in this embodiment illustrated, the nozzle ports 120 in one of the manifolds are offset laterally from the nozzle ports in the other manifold a distance X equal to one-half the distance Y between adjacent nozzle orifices in the manifolds. Also, the distance Z of transverse reciprocative movement of the manifolds, by movement of the carriage 60, is equal to X.

Further, the speed of transverse movement of the carriage 60, and hence the manifolds and nozzle ports, is chosen to be the same as the speed of longitudinal movement of the conveyor belt 112. Accordingly, the cutting lines of the high pressure water jets produce the illustrated zig-zag pattern of 45 degree crossing lines that produce square dices D of dimensions X.

From the foregoing, it will be apparent that, like the embodiment first described, dices D of various dimensions and configurations may be produced by varying the spacings between nozzle ports 120 and by varying the speeds of movement of the manifolds and conveyor belt.

It will be apparent to those skilled in the art that various changes may be made in the size, shape, type, number and arrangement of parts described hereinbefore. For and arrangement of parts described hereinbefore. For example, the high pressure water jet line-type cutter mechanism may be replaced with a laser assembly or other line-type cutter mounted on carriage 60. Although the operation has been described herein as producing diced food products, it will be understood that the method and apparatus also may be utilized to dice a wide range of other types of products. These and other changes and modifications may be made without departing from the spirit of this invention and the scope of the appended claims.

We claim:

1. A method of producing diced product, comprising moving a product in a longitudinal direction on a moving conveyor, and cutting the moving product with a plurality of line type cutters mounted on a movable carriage and extending parallel to and in the direction of longitudinal movement of the conveyor by reciprocating the carriage in a direction transverse to and across the moving conveyor at a rate of speed relative to the rate of speed of the moving conveyor predetermined to cut the product into a plurality of dices of selected shape and size.

2. The method of claim 1 wherein the plurality of cutters on the carriage extend in the direction of longitudinal movement of the conveyor over a length A at least equal to twice the length B of the transverse reciprocation less the distance a between adjacent cutters and the rate of speed of transverse reciprocation of the carriage and supported plurality of cutters is the same as the rate of longitudinal movement of the conveyor, whereby to produce diced product of square configuration.

3. The method of claim 1 wherein the rate of speed of transverse reciprocation of the carriage and supported plurality of cutters is the same as the rate of longitudinal movement of the conveyor, whereby to produce diced product of square configuration.

4. The method of claim 1 wherein the rate of speed of transverse reciprocation of the carriage and supported plurality of cutters is different from the rate of longitudinal movement of the conveyor, whereby to produce diced product of diamond configuration.

5. The method of claim 1 wherein the product is a food product.

6. The method of claim 1 wherein the product is a food product and the method includes the step, prior to cutting the food product, of subjecting the moving food product to compression to remove entrapped air in the food product.

7. A method of producing diced product, comprising mounting a plurality of line type cutters on a carriage movable in a direction transverse to and across a longitudinally movable conveyor, the cutters extending in said direction transverse to and across the conveyor in two rows spaced apart in the direction of longitudinal movement of the conveyor, the cutters in one row being mounted on said carriage so as to be displaced transversely relative to the cutters in the other row, the cutters of both rows being movable together with the carriage, moving a product in a longitudinal direction on the moving conveyor, and cutting the moving product with the plurality of line type cutters reciprocating the carriage in said direction transverse to and across the moving conveyor a distance and at a rate of speed relative to the rate of speed of the moving conveyor predetermined to cut the product into a plurality of dices of selected shape and size.

8. Apparatus for producing diced product, comprising:

a) a longitudinally movable conveyor for supporting food product to be diced, b) conveyor drive means for moving the conveyor at a predetermined rate of speed, c) a plurality of line type cutters supported on a movable carriage and extending parallel to and in the direction of longitudinal movement of the conveyor for reciprocation with the carriage in a direction transverse to and across the longitudinally movable conveyor, the cutters being operable to cut the product during movement of the carriage in both directions of reciprocation, and d) cutter carriage drive means for reciprocating the carriage in said direction transverse to and across the conveyor at a rate of speed relative to the rate of speed of movement of the conveyor predetermined to cut the product into a plurality of dices of selected size and shape.

9. The apparatus of claim 8 wherein the plurality of cutters or the carriage extend in the direction of longitudinal movement of the conveyor over a length at least equal to twice the length of transverse reciprocation of the cutters and carriage less the distance between adjacent cutters.

10. The apparatus of claim 8 wherein the conveyor is of wire mesh and the plurality of line type cutters are high pressure water jet cutters.

11. The apparatus of claim 10 including an elongated water manifold on the movable carriage mounting the plurality of high pressure water jets cutters spaced apart in the longitudinal direction of the conveyor.

12. The apparatus of claim 8 for producing diced food product and including a flattening roll mounted above the conveyor and arranged to compress food product moving with the conveyor to remove entrapped air in the food product.

13. Apparatus for producing diced product, comprising:

a) a longitudinally movable conveyor for supporting food product to be diced, b) conveyor drive means for moving the conveyor at a predetermined rate of speed, c) a movable carriage mounted for reciprocative movement in a direction transverse to and across the longitudinally movable conveyor, d) a plurality of line type cutters supported on the movable carriage and extending in said direction transverse to and across the conveyor in two rows spaced apart in the direction of longitudinal movement of the conveyor, the cutters in one row being mounted on said carriage so as to be displaced transversely relative to the cutters in the other row, the cutters of both rows being movable together with the supporting carriage for reciprocation with the carriage in said direction transverse to and across the longitudinally movable conveyor, the cutter being operable to cut the product during movement of the carriage in both directions of reciprocation, and e) cutter carriage drive means for reciprocating the carriage in said direction transverse to and across the conveyor a distance and at a rate of speed relative to the rate of speed of movement of the conveyor predetermined to cut the product into a plurality of dices of selected size and shape.

14. The apparatus of claim 13 wherein the conveyor is of wire mesh and the plurality of line type cutters are high pressure water jet cutters.

15. The apparatus of claim 14 including two elongated water manifolds on the movable carriage mounting the plurality of high pressure water jet cutters, the manifolds extending transversely across the conveyor and spaced apart in the longitudinal direction of the conveyor.

* * * * *

UNITED STATES PATENT AND TRADEMARK OFFICE

CERTIFICATE OF CORRECTION

PATENT NO. : 5,243,886

DATED : 14 September 1993

INVENTOR(S) : Norman A. Rudy, James S. Tomlin & Bret J. Larreau

It is certified that error appears in the above-identified patent and that said Letters Patent is hereby corrected as shown below:

Column 7, line 54, "cutters reciprocating" should read--cutters by reciprocating--.

Column 8, line 13, "or the" should read --on the--.

Signed and Sealed this

Fifth Day of April, 1994

Bruce Lehman

BRUCE LEHMAN

*Commissioner of Patents and Trademarks*

*Attest:*

*Attesting Officer*